United States Patent [19]

Lohnherr

[11] Patent Number: 5,055,182

[45] Date of Patent: Oct. 8, 1991

[54] SEPARATOR

[75] Inventor: Ludger Lohnherr, Oelde, Fed. Rep. of Germany

[73] Assignee: Krupp Polysius AG, Fed. Rep. of Germany

[21] Appl. No.: 456,727

[22] Filed: Dec. 26, 1989

[30] Foreign Application Priority Data

Jan. 12, 1989 [DE] Fed. Rep. of Germany ..... 3900779

[51] Int. Cl.[5] ..... B07B 9/02

[52] U.S. Cl. ..... 209/148; 209/139.2; 209/149

[58] Field of Search ..... 209/149, 139.2, 148

[56] References Cited

U.S. PATENT DOCUMENTS

| | | | |
|---|---|---|---|
| 3,901,794 | 8/1975 | Henne et al. | 209/139.2 |
| 4,059,507 | 11/1977 | Nobuo | 209/139.2 |
| 4,100,061 | 7/1978 | Eickholt et al. | 209/139.2 |
| 4,388,183 | 6/1983 | Thomas | 209/139.2 |
| 4,564,442 | 1/1986 | Jäger | 209/148 |
| 4,693,811 | 9/1987 | Lohnherr | 209/148 |
| 4,756,428 | 7/1988 | Jäeger | 209/148 |

*Primary Examiner*—Robert R. Song

*Attorney, Agent, or Firm*—Learman & McCulloch

[57] ABSTRACT

The invention relates to a pneumatic separator for separating relatively coarse and relatively fine particles and in which a material distributor plate is arranged below the rotor and guide unit in such a way that the material thrown off by the rotor passes into the stream of separating air flowing towards the guide unit.

12 Claims, 2 Drawing Sheets

SEPARATOR

The invention relates to a pneumatic separator for separating relatively fine and relatively coarse particles.

BACKGROUND OF THE INVENTION

A separator of the general class to which the invention relates is known for example from EP-A-O 221 246. In this known separator the material distributor plate is located above the rotor and the material to be separated is delivered to the material distributor plate through the cover of the separator housing. The material which is homogenised by the material distributor plate is introduced from above into the separating chamber located between the stationary guide unit and the rotor.

The object of the invention is to improve the known separator in such a way that its design is simplified and at the same time the overall height of the separator and of the circulating elevator used for conveying the material to be separated is reduced.

SUMMARY OF THE INVENTION

According to the invention the material distributor plate is arranged below the rotor and the guide unit in such a way that the material thrown off by the material distributor plate passes into the stream of separating air flowing towards the guide unit.

In this case a nozzle through which the stream of separating air flows accelerates it to high speed and with low pressure loss in the zone in which the material thrown off by the material distributor plate passes into the stream of separating air.

The arrangement of the material distributor plate below the rotor and the guide unit brings with it a substantial simplification of the design. Thus the omission of a material distributor plate on the top of the rotor results in a substantial simplification of the seal between the rotor and the channel which serves for discharge of the stream of separating air charged with fines. Since the material to be separated is no longer delivered through the cover of the separator housing, the means for adjusting the guide vanes of the guide unit can be arranged without difficulty on the cover of the separator housing.

The arrangement of the material distributor plate below the rotor and the guide unit also reduces the overall height of the separator. Because the connection for the material feed arrangement is located on the outside and substantially lower than in the past, the external circulating elevator which is used for delivering the material to be separated can also be kept shorter. Finally, it is advantageous that a simple standardisation of the construction of separators with and without a material distributor plate is possible, since the essential components such as the guide blade mounting and adjustment, material feed channel and external housing, are the same in both cases.

The arrangement of a nozzle which increases the gas speed of the stream of separating air in the zone in which the material which is thrown off by the material distributor plate enters the stream of separating air ensures a reliable pneumatic transport of the material into the somewhat higher separating zone in the region of the rotor and guide vane system.

THE DRAWINGS

One embodiment of the invention is illustrated in the drawings, in which:

FIG. 1 is a diagrammatic vertical section through a separator according to the invention, and FIG. 2 is a partial horizontal section through the separator according to FIG.1 along the dot-dash section line.

DETAILED DESCRIPTION

Figure 1:
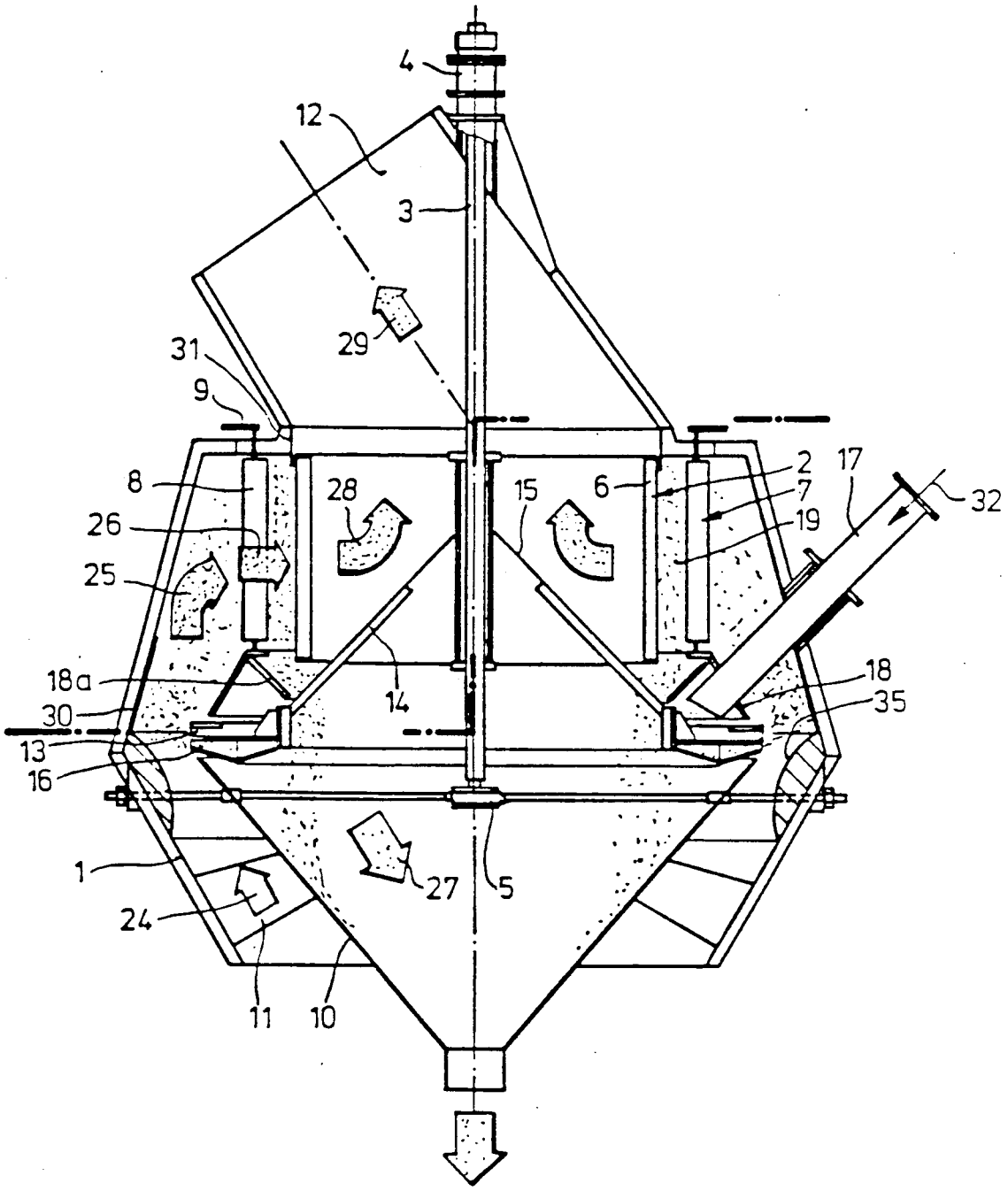

The separator which is shown schematically in the drawings contains in a housing 1 a rotor 2 rotatable about a vertical axis and driven by a motor, the shaft 3 of the said rotor being mounted in an upper bearing 4 and a lower bearing 5. The rotor 2 has blades 6 spaced from one another on its periphery.

The rotor 2 is encircled at a distance by a stationary guide unit 7, the guide vanes 8 of which are adjustable by means of adjustment means 9 which pass through the cover externally of the housing 1.

A tailings hopper 10 which is borne by support plates 11 is located at a level below the rotor 2 and the guide unit 7 in the housing 1.

An exhaust channel 12 which serves to discharge the stream of separating air charged with fines upwards is connected to the cover of the separator housing 1 above the rotor 2.

A material distributor plate 13 is connected to the rotor 2 so as to be fixed against rotation relative thereto by bars 14 which are constructed as hollow sections and are arranged spaced from one another in the peripheral direction. The bars 14 are fixed to a cone 15 which serves to reinforce the rotor 2.

An annular distributor plate 16 which is also rotatable with the rotor 2 and is also borne by the bars 14 is arranged at a level below the material distributor plate 13.

A material feed chute 17 which is passed at an angle through the annular chamber outside the guide unit 7 and communicates with the material distributor plate 13 serves to deliver the material to be separated to the material distributor plate 13.

A stationary annular cover 18 through which the material feed chute 17 is passed is also provided above the material distributor plate 13. The cover 18 has a radially inner wall cone **18*a* which tapers downwards like a funnel and underlies the spare or separating chamber which lies between the guide unit 7 and the rotor 2**.

Figure 2:
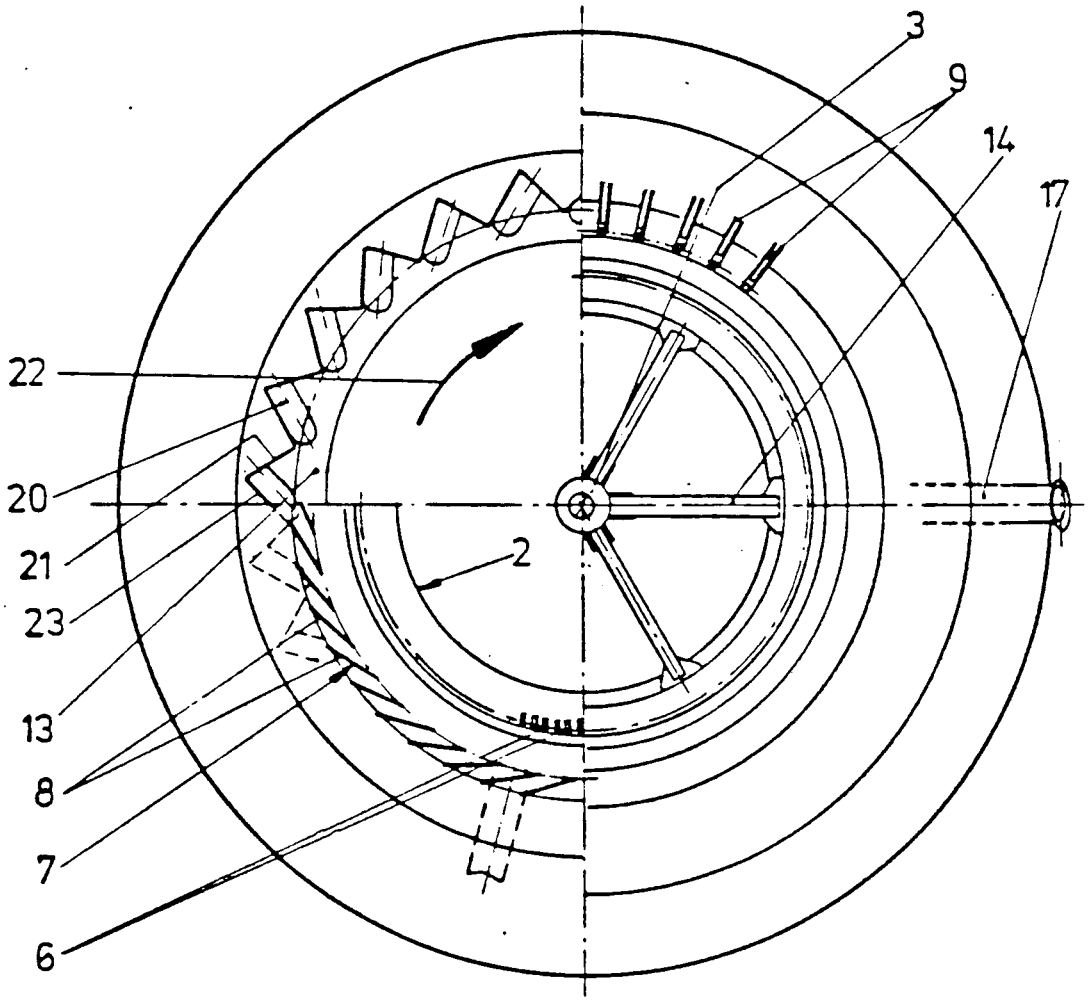

As FIG. 2 in particular shows, the material distributor plate 13 is provided in its peripheral region with a number of openings 20 which are evenly distributed around the periphery. On the outside each of these openings 20 is defined by a guide element 21 which is inclined with respect to the radial direction in the direction of rotation (arrow 22) of the material distributor plate 13.

Baffles 23 which are inclined with respect to the radial direction against the direction of rotation of the material distributor plate 13 are arranged between the radially outer end of the individual guide elements 21 and the radially inner end of the adjacent guide elements. The construction of the material distributor plate 13 corresponds to that described in EP-A-O 221 246.

In detail, the separator functions as follows:

A stream of separating air flows upwardly through the housing 1 to the guide unit 7 (arrows 24, 25). The material to be separated which is delivered via the material feed chute 17 to the material distributor plate 13 is homogenised on the material distributor plate 13 and thrown off through the openings 20 onto the distributor plate 16. By means of the distributor plate 16 the material is moved outwards in the radial direction and introduced into the rising stream of separating air, passing with the stream of separating air into the separating chamber 19 between the guide unit 7 and the rotor 2 (arrow 26). A nozzle 35 adjacent the distributor plate 16 accelerates the stream of separating air passes at a high gas speed and low pressure loss through the zone in which the material thrown off from the material distributor plates 13 and 16 passes into the stream of separating air. In this way the material thrown off from the material distributor plate 13 is reliably delivered to the guide unit 7 and the rotor 2.

The tailings falling downwards in the separating chamber 19 are guided over the wall 18*a* of the cover 18 and through the spaces between the bars 14 into the tailings hopper 10 (arrow 27). The fines pass with the stream of separating air into the rotor 2 and leave the separator through the exhaust channel 12 (arrows 28, 29).

The majority of the material to be separated is delivered to the separator via the material feed chute. A small proportion of the material to be separated can be delivered from below by the stream of separating air (arrow 24) (for example when the separator is arranged above a roll mill, the tailings discharged in the separator being returned via the tailings hopper 10 to the grinding track of the roll mill).

The cover 18 shields the material feed against the surrounding, and in particular prevents the tailings precipitated in the separating chamber 19 from falling back onto the material distributor plate 13.

The inner wall of the separator housing 1 is provided with a protective liner 30 in the region where the material scattered outwards by the distributor plate 16 strikes this inner wall. Relatively coarse particles which strike the liner 30 of the separator housing 1 are braked and fall back downwards so that (in the case of the separator arranged above a roll mill) they fall back into the mill chamber.

The relatively fine particles pass with the stream of separating air into the separating chamber 19.

Thus a preliminary separation of tailings is achieved before the stream of separating air with the material to be separated enters the separating chamber, and therefore the sifting chamber is relieved of the load of coarse particles, which is very desirable and contributes significantly to the improvement of the selectivity.

The drawings also demonstrate the further advantages of the separator according to the invention:

There is a simple seal between the rotor 2 and the channel 12 by means of a cylindrical connecting piece 31 which engages over the rotor with a small clearance.

The guide vanes 8 can be actuated in a simple manner by adjusting means 9 mounted on the cover of the housing 1.

A substantial reduction in the overall height of the separator is produced by the arrangement of the material distributor plate 16 below the guide unit 7 and the rotor 2.

The material delivery to the low-lying material distributor plate 13 by means of the material feed chute 17 which passes at an angle through the annular chamber before the guide unit 7 facilitates a reduction in the height of the circulating elevator, which is usually used for delivery of the material to be separated (arrow 32).

Finally, the construction according to the invention facilitates a simple standardisation for separators which are constructed with and without a distributor arrangement.

The invention will be explained in greater detail below with the aid of the following example.

The effectiveness of the described separator is demonstrated with a roller mill with a grinding plate diameter of 3.6 m. The object of the experiment was to show that the capacity of the mill becomes better and the pressure loss and power consumption become lower the more the separator is operated in the manner described and the further one distances oneself from the conventional operation of a roller mill with pneumatic transport of the material feed to the separator. In order to carry out the experiment the free gas passage area is increased by 16% by the nozzle ring around the grinding plate and the gas speed in the nozzle ring is further reduced by decreasing the quantity of gas. These measures ensure that less material is delivered to the separator pneumatically and much more material falls through the nozzle ring and is delivered to an elevator which supplies the distributor plate of the separator. The results of these measures are set out in the following table.

| | | | | |
|---|---|---|---|---|
| Quantity of material to the distributor plate of the separator | | low | average | high |
| Pneumatic transport within the roller mill | | high | average | low |
| Gas speed in the nozzle ring | % | 100 | 83 | 74.5 |
| Material to the distributor plate of the separator | t/h | 50 | 150 | 250 |
| Capacity of the roller mill system | t/h | 150 | 177 | 185 |

The example shows that the capacity of the roller mill system increased from 150 t/h with conventional operation to 185 t/h if a separator of the described construction is installed and operated so that as much material as possible is delivered to the distributor plate. With this increase in capacity it should be noted that the fineness of the finished product was constant at all experimental settings with a residue of 1.6–2% on the 200 μm screen and 22–23% on the 90 μm screen. The example also shows that the power consumption of the roller mill system, measured in kWh/t of product, falls from 100 to 82% if the separator is operated in the manner described here.

I claim:

1. A pneumatic separator for separating relatively coarse and relatively fine particles, said separator comprising a housing; a rotor mounted in said housing for rotation about a vertical axis; distributor means carried by said rotor for rotation therewith; feed means for delivering to said distributor means material to be separated; guide means encircling and outwardly spaced from said rotor to provide a clearance between said guide means and said rotor through which an upwardly flowing separating air stream may flow; exhaust means communicating with the interior of said housing at its upper end and through which said air stream and particles entrained therein may flow outwardly of said housing, said distributor means being at a level below that of said rotor and said guide means so that material thrown off said distributor means enters the air stream at a zone below the level of said rotor and said guide means; and means for accelerating the rate of flow of said air stream at said zone.

2. The separator according to claim 1 wherein said distributor means is fixed to said rotor for rotation therewith by means of circumferentially spaced bars joined at corresponding ends to said distributor means and said rotor.

3. The separator according to claim 1 including second material distributor means carried by said rotor and positioned at a level below that of the first-mentioned distributor means.

4. The separator according to claim 1 wherein the material distributor means has a plurality of uniformly, circumferentially spaced openings at its periphery.

5. The separator according to claim 4 including a guide element at the outer end of each of said openings, each of said guide elements being inclined radially and in the direction of rotation of said distributor means.

6. The separator according to claim 5 including a baffle inclined radially and against the direction of rotation of said distributor, each of said baffles being between the outer end of one of said guide elements and the inner end of an adjacent guide element.

7. The separator according to claim 1 wherein said feed means comprises a chute extending from outside said housing into the latter and being in communication with said material distributor means.

8. The separator according to claim 7 including a stationary, annular cover overlying said material distributor means and through which said chute extends.

9. The separator according to claim 8 wherein said cover has its radially inner surface tapering downwardly and underlying said clearance for guiding particles falling downwardly through said clearance.

10. The separator according to claim 1 including a tailings hopper within said housing and underlying said rotor and said distributor means.

11. The separator according to claim 1 wherein said guide means includes a plurality of adjustable vanes, and means external of said housing connected to said guide means for adjusting them.

12. A pneumatic separator for separating relatively coarse and relatively fine particles, said separator comprising a housing; a rotor mounted in said housing for rotation about a vertical axis; distributor means carried by said rotor for rotation therewith; feed means for delivering material to be separated to said distributor means; guide means encircling and outwardly spaced from said rotor to provide a clearance between said guide means and said rotor through which an upwardly flowing separating air stream may flow; exhaust means communicating with the interior of said housing at its upper end and through which said air stream and particles entrained therein may flow outwardly of said housing, said distributor means being at a level below that of said rotor and said guide means so that material thrown off said distributor means enters the air stream at a zone below the level of said rotor and said guide means; means for accelerating the rate of flow of said air stream at said zone; a tailings hopper underlying said rotor and said distributor means; and annular cover means overlying said distributor means and underlying said clearance, said cover means having an inner wall tapering downwards and communicating with said hopper for guiding particles falling downwardly through said clearance into said hopper.

* * * * *